US007890042B2

(12) United States Patent
Ishida et al.

(10) Patent No.: US 7,890,042 B2
(45) Date of Patent: Feb. 15, 2011

(54) IMAGE FORMING APPARATUS WITH FIXING UNIT HAVING INDUCTION HEATING MEMBER AND SHIELDING MEMBER FOR CONTROLLING INDUCTION HEATING

(75) Inventors: Naoyuki Ishida, Osaka (JP); Akihiro Kondo, Osaka (JP); Yuzuru Nanjo, Osaka (JP); Syoukou Gon, Osaka (JP); Kenichi Kasama, Osaka (JP); Eiji Nakajima, Osaka (JP)

(73) Assignee: Kyocera Mita Corporation (JP)

( * ) Notice: Subject to any disclaimer, the term of this patent is extended or adjusted under 35 U.S.C. 154(b) by 101 days.

(21) Appl. No.: 12/390,569

(22) Filed: Feb. 23, 2009

(65) Prior Publication Data

US 2009/0269109 A1 Oct. 29, 2009

(30) Foreign Application Priority Data

Mar. 7, 2008 (JP) ..... 2008-057316

(51) Int. Cl.
*G03G 15/20* (2006.01)

(52) U.S. Cl. ..... 399/329; 399/330; 219/619

(58) Field of Classification Search ..... 219/619; 399/67, 328–330

See application file for complete search history.

(56) References Cited

U.S. PATENT DOCUMENTS

RE36,962 E 11/2000 Higashi et al.
7,266,336 B2 * 9/2007 Ueno et al. ..... 399/329

FOREIGN PATENT DOCUMENTS

JP 6-318001 11/1994
JP 2006-163200 6/2006
JP 2006-267180 10/2006

* cited by examiner

*Primary Examiner*—Hoang Ngo
(74) *Attorney, Agent, or Firm*—Gerald E. Hespos; Michael J. Porco

(57) ABSTRACT

An image forming apparatus includes an image forming unit and a fixing unit. The fixing unit includes a heating member; a coil arranged along an outer surface of the heating member for generating a magnetic field for induction heating the heating member; a core arranged to face the heating member with the coil located therebetween in order to form a magnetic path around the coil and made of a magnetic material; a shielding member arranged near the magnetic path generated by the coil, including a closed frame portion and made of a nonmagnetic metal; and a magnetic shielding portion for displacing the shielding member between a retracted position for permitting a magnetic flux to pass along a frame surface virtually formed inside the closed frame portion and a shielding position for shielding magnetism by the penetration of a magnetic flux inside the frame surface.

20 Claims, 8 Drawing Sheets

IMAGE FORMING APPARATUS WITH FIXING UNIT HAVING INDUCTION HEATING MEMBER AND SHIELDING MEMBER FOR CONTROLLING INDUCTION HEATING

BACKGROUND OF THE INVENTION

1. Field of the Invention

The present invention relates to an image forming apparatus provided with a fixing unit for permitting a sheet bearing a toner image to pass between a heating member and a pressing member to heat and melt unfixed toner and fix it to the sheet.

2. Description of the Related Art

In recent years, attention has been focused on belt-type image forming apparatuses, in which a smaller heat capacity can be set, due to demands of shortening a warm-up time and saving energy in a fixing unit (see, for example, Japanese Unexamined Patent Publication No. H06-318001). Attention has been also focused on an electromagnetic induction heating method (IH) with a possibility of quick heating and high efficiency heating in recent years, and many products as a combination of electromagnetic induction heating and the employment of a belt have commercialized in light of saving energy upon fixing a color image. In the case of combining the employment of a belt and electromagnetic induction heating, an electromagnetic induction device is often arranged at an outer side of the belt due to merits that a coil can be easily laid out and cooled and further the belt can be directly heated (so-called external IH).

In the above electromagnetic induction heating method, various technologies have been developed to prevent an excessive temperature increase in a paper non-passage area in consideration of a sheet width (paper width) passed through the fixing unit. Particularly, the following prior arts are known as size switching means in the external IH.

An apparatus of a first prior art (Japanese Unexamined Patent Publication No. 2006-163200) has a function of displacing magnetic shielding members arranged between an induction heating coil and a core between a magnetic path shielding position located at a coil center and a magnetic path releasing position located at a wound part of the coil. According to the first prior art, if the magnetic shielding members are displaced from the wound part of the coil to the coil center, a magnetic path corresponding to a paper non-passage area of a heating roller is shielded, wherefore an excessive temperature increase in the paper non-passage area of the heating roller can be prevented by a small-size construction.

An apparatus of a second prior art (Japanese Unexamined Patent Publication No. 2006-267180) shields magnetism by using a magnetic shielding plate having high magnetic permeability and high electrical resistance. Particularly, according to the second embodiment, the magnetic shielding plate is normally located outside a gap between a fixing roller and a magnetic flux generator, but moves into the gap as a thermal actuator is deformed upon reaching a high temperature.

However, the magnetic shielding members used in the first prior art are aluminum plates having a certain wide area. Even if these aluminum plates are moved to the magnetism releasing position, they overlap with the coil, which exhibits a certain magnetic shielding effect. Therefore, the first prior art has a problem of deteriorating heat transfer efficiency during heating.

On the other hand, the second prior art has no problem of exhibiting the magnetic shielding effect when the magnetic shielding plate is retracted as described above since the magnetic shielding plate is retracted to the outside of the gap. However, a storage space is necessary upon retracting the magnetic shielding plate to the outside of the gap, which causes another problem of forcing an installation space for the coil and the like to be reduced by that much. Therefore, according to the second prior art, it is difficult to ensure a sufficient installation area for the coil for the fixing roller and there is a problem of leading to a corresponding reduction in heating efficiency. In order to compensate for this, the fixing roller itself needs to be enlarged. However, since the enlargement of the fixing roller leads to an increase in heat capacity, it is unfavorable in shortening a warm-up time.

SUMMARY OF THE INVENTION

An object of the present invention is to provide an image forming apparatus which does not uselessly increase an installation space for a member for magnetic adjustment and makes it difficult to exhibit a magnetic shielding effect with the member for magnetic adjustment retracted during induction heating.

In order to accomplish this object, one aspect of the present invention is directed to an image forming apparatus, comprising an image forming unit for transferring a toner image to a sheet; and a fixing unit including a heating member and a pressing member and adapted to convey the sheet while holding the sheet between the heating member and the pressing member and to fix the toner image to the sheet by heat at least from the heating member in a conveying process, wherein the fixing unit further includes a coil arranged along an outer surface of the heating member for generating a magnetic field for induction heating the heating member; a core arranged to face the heating member with the coil located therebetween in order to form a magnetic path around the coil and made of a magnetic material; a shielding member arranged near the magnetic path generated by the coil, including a closed frame portion and made of a nonmagnetic metal; and a magnetic shielding portion for displacing the shielding member between a retracted position for permitting a magnetic flux to pass along a frame surface virtually formed inside the closed frame portion and a shielding position for shielding magnetism by the penetration of a magnetic flux inside the frame surface.

These and other objects, features, aspects and advantages of the present invention will become more apparent upon a reading of the following detailed description and accompanying drawings.

DETAILED DESCRIPTION OF THE PREFERRED EMBODIMENTS

Hereinafter, one embodiment of the present invention is described with reference to the accompanying drawings.

Figure 1:
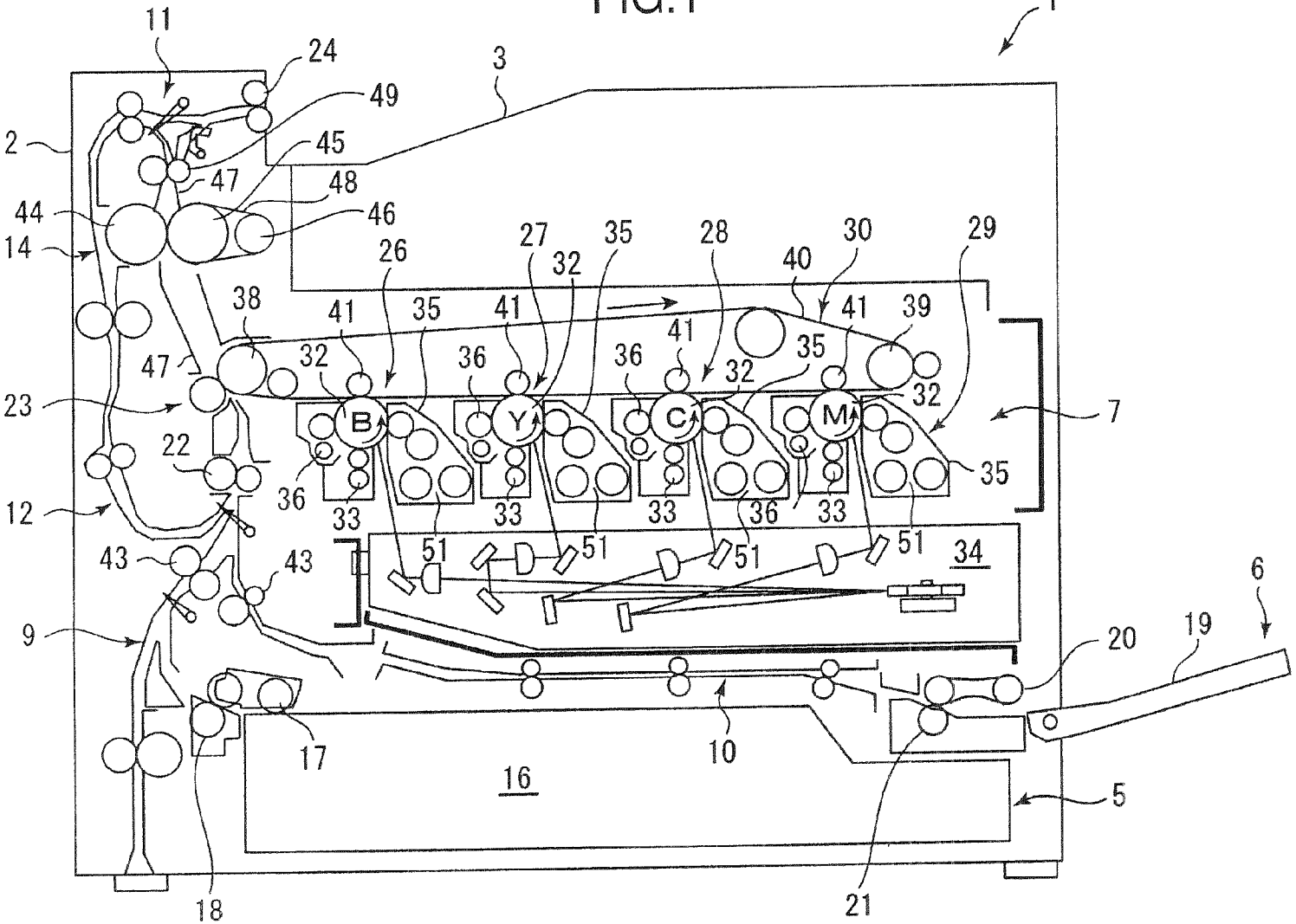
FIG. 1 is a schematic diagram showing the construction of an image forming apparatus according to one embodiment.

FIG. 1 is a schematic diagram showing the construction of an image forming apparatus 1 according to one embodiment of the present invention. The image forming apparatus 1 can be a printer, a copier, a facsimile machine, a complex machine provided with these functions or the like for printing by transferring a toner image to the surface of a print medium such as a print sheet, for example, in accordance with externally inputted image information.

The image forming apparatus 1 shown in FIG. 1 is a tandem color printer. This image forming apparatus 1 is provided with an apparatus main body 2 in the form of a rectangular box for forming (printing) a color image on a sheet inside. A sheet discharging unit (discharge tray) 3 for discharging a sheet having a color image printed thereon is provided in a top part of the apparatus main body 2.

A sheet cassette 5 for storing sheets is arranged at the bottom in the interior of the apparatus main body 2, a stack tray 6 for manually feeding a sheet is arranged in an intermediate part, and an image forming station 7 is arranged in an upper part. The image forming station 7 forms (transfers) a toner image on a sheet based on image data such as characters and pictures transmitted from the outside of the apparatus.

A first conveyance path 9 for conveying a sheet dispensed from the sheet cassette 5 to the image forming station 7 is arranged in a left part of the apparatus main body 2 in FIG. 1, and a second conveyance path 10 for conveying a sheet dispensed from the stack tray 6 to the image forming station 7 is arranged from a right part to the left part. Further, a fixing unit 14 for performing a fixing process to a sheet having an image formed thereon in the image forming station 7 and a third conveyance path 11 for conveying the sheet finished with the fixing process to the sheet discharging unit 3 are arranged in a left upper part in the apparatus main body 2.

The sheet cassette 5 enables the replenishment of sheets by being withdrawn toward the outside (e.g. toward front side in FIG. 1) of the apparatus main body 2. This sheet cassette 5 includes a storing portion 16, which can selectively store at least two types of sheets having different sizes in a feeding direction. Sheets stored in the storing portion 16 are dispensed one by one toward the first conveyance path 9 by a feed roller 17 and separation rollers 18.

The stack tray 6 can be opened and closed relative to an outer surface of the apparatus main body 2, and sheets to be manually fed are placed one by one or a plurality of sheets are placed on a manual feeding portion 19. Sheets placed on the manual feeding portion 19 are dispensed one by one toward the second conveyance path 10 by a pickup roller 20 and separation rollers 21.

The first conveyance path 9 and the second conveyance path 10 join before registration rollers 22. A sheet fed to the registration rollers 22 temporarily waits on standby here and is conveyed toward a secondary transfer unit 23 after a skew adjustment and a timing adjustment. A full color toner image on an intermediate transfer belt 40 is secondarily transferred to the conveyed sheet in the secondary transfer unit 23. Thereafter, the sheet having the toner image fixed in the fixing unit 14 is reversed in a fourth conveyance path 12 if necessary, so that a full color toner image is secondarily transferred also to the opposite side of the sheet in the secondary transfer unit 23. After the toner image on the opposite side is fixed in the fixing unit 14, the sheet is discharged to the sheet discharging unit 3 by discharge rollers 24 through the third conveyance path 11.

The image forming station 7 includes four image forming units 26, 27, 28 and 29 for forming toner images of black (B), yellow (Y), cyan (C) and magenta (M) and an intermediate transfer unit 30 for bearing the toner images of the respective colors formed in the image forming units 26 to 29 in a superimposed manner.

Each of the image forming units 26 to 29 includes a photoconductive drum 32, a charger 33 arranged to face the circumferential surface of the photosensitive drum 32, a laser scanning unit 34 arranged downstream of the charger 33 for emitting a laser beam to a specific position on the circumferential surface of the photosensitive drum 32, a developing device 35 arranged to face the circumferential surface of the photosensitive drum 32 downstream of a laser beam emission position from the laser scanning unit 34 and a cleaning device 36 arranged downstream of the developing device 35 to face the circumferential surface of the photosensitive drum 32.

The photosensitive drum 32 of each of the image forming units 26 to 29 is rotated in a counterclockwise direction of FIG. 1 by an unillustrated drive motor. Black toner, yellow toner, cyan toner and magenta toner are respectively contained in toner boxes 51 of the developing devices 35 of the respective image forming units 26 to 29.

The image transfer unit 30 includes a drive roller 38 arranged at a position near the image forming unit 26, a driven roller 39 arranged at a position near the image forming unit 29, the intermediate transfer belt 40 mounted on the drive roller 38 and the driven roller 39 and four transfer rollers 41 arranged in correspondence with the photosensitive drums 32 of the respective image forming units 26 to 29. The respective transfer rollers 41 are arranged at positions downstream of the developing devices 35 of the corresponding image forming units 26 to 29 such that they can be pressed into contact with the corresponding photosensitive drums 32 via the intermediate transfer belt 40.

In this image transfer unit 30, the toner images of the respective colors are transferred in a superimposition manner on the intermediate transfer belt 40 at the positions of the transfer rollers 41 of the respective image forming units 26 to 29. As a result, a full color toner image is finally formed on the intermediate transfer belt 40.

The first conveyance path 9 conveys a sheet dispensed from the sheet cassette 5 toward the image transfer unit 30. The first conveyance path 9 includes a plurality of conveyor rollers 43 arranged at specified positions in the apparatus main body 2 and the registration rollers 22 arranged before the image transfer unit 30 for timing an image forming operation and a sheet feeding operation in the image forming station 7.

The fixing unit 14 fixes an unfixed toner image to a sheet by heating and pressing the sheet having the toner image transferred thereto in the image forming station 7. The fixing unit 14 includes a pair of rollers comprised of a heating pressure roller 44 (pressing member) and a fixing roller 45. The pressure roller 44 is a metallic roller, and the fixing roller 45 is comprised of a metallic core material, an outer layer (e.g. silicon sponge) made of elastic material and a mold releasing layer (e.g. PFA). Further, a heat roller 46 is disposed adjacent to the fixing roller 45, and a heating belt 48 (heating member) is mounted on this heat roller 46 and the fixing roller 45. A detailed structure of the fixing unit 14 is described later.

Conveyance paths 47 are arranged upstream and downstream of the fixing unit 14 in a sheet conveying direction. A sheet conveyed through the image transfer unit 30 is introduced to a nip between the pressure roller 44 and the fixing roller 45 (heating belt 48) via the upstream conveyance path 47. The sheet having passed between the pressure roller 44 and the fixing roller 45 is guided to the third conveyance path 11 via the downstream conveyance path 47.

The third conveyance path 11 conveys the sheet finished with the fixing process in the fixing unit 14 to the sheet discharging unit 3. Thus, conveyer rollers 49 are arranged at a suitable position in the third conveyance path 11 and the above discharge rollers 24 are arranged at the exit of the third conveyance path 11.

<Details of the Fixing Unit>

Next, the details of the fixing unit 14 employed in the above image forming apparatus 1 are described.

Figure 2:
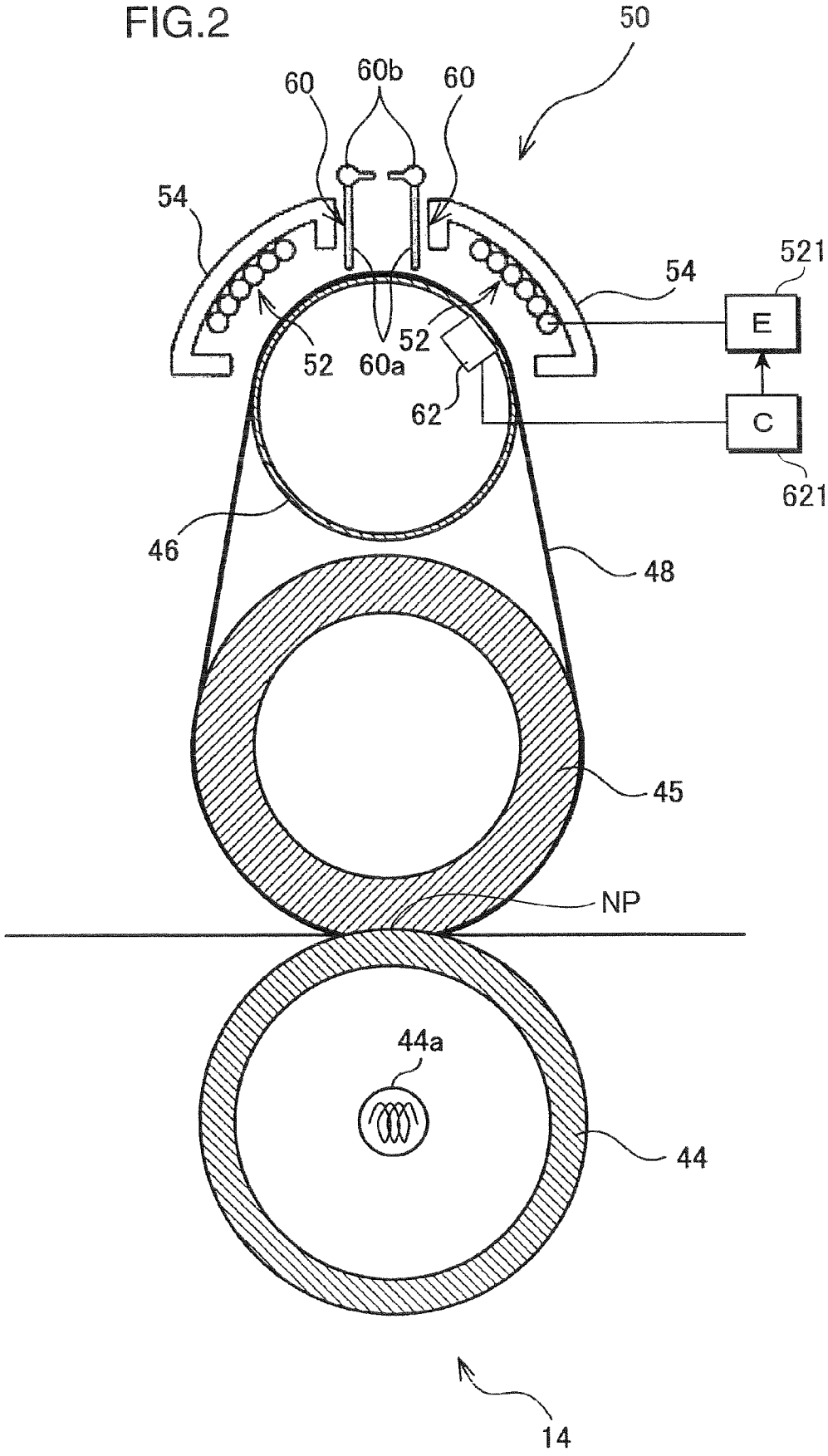
FIG. 2 is a vertical section showing the construction of a fixing unit according to the embodiment.

FIG. 2 is a vertical section showing the construction of the fixing unit 14 of this embodiment. In a state shown in FIG. 2, the orientation of the fixing unit 14 is rotated counterclockwise by about 90° from an actually mounted state in the image forming apparatus 1. Accordingly, the sheet conveying direction from lower side to upper side in FIG. 1 is from right side to left side in FIG. 2. If the apparatus main body 2 has a larger size (complex machine or the like), the fixing unit 14 may be actually mounted in the orientation shown in FIG. 2. Further, as another layout, the fixing unit 14 may be arranged while being inclined either to left or to right from the state shown in FIG. 2.

The fixing unit 14 includes the pressure roller 44, the fixing roller 45, the heat roller 46 and the heating belt 48 as described above. As described above, the pressure roller 44 is made of a metal, but the fixing roller 45 includes the elastic layer of silicon sponge as the outer layer. Thus, a flat nip NP is formed between the heating belt 48 and the fixing roller 45. It should be noted that a halogen heater 44*a* is disposed in the pressure roller 44. A base member of the heating belt 48 is made of a ferromagnetic material (e.g. Ni), a thin elastic layer (e.g. silicon rubber) is formed on the outer surface of the base member, and a mold releasing layer (e.g. PFA) is formed on the outer surface of the elastic layer. A core of the heat roller 46 is made of a magnetic metal (e.g. Fe) and a mold releasing layer (e.g. PFA) is formed on the outer surface of the core.

The fixing unit 14 conveys the sheet while holding it in the nip NP between the pressure roller 44 and the fixing roller 45 via the heating belt 48. In this conveyance process, the sheet receives heat from the pressure roller 44 and the heating belt 48, whereby the toner image transferred onto the sheet is fixed to the sheet.

The fixing unit 14 further includes an IH coil unit 50 (not shown in FIG. 1) at an outer side of the heat roller 46 and the heating belt 48. The IH coil unit 50 is provided with an induction heating coil 52 (coil), a pair of arch cores 54 (core), magnetic shielding members 60 (shielding member) and a temperature controller including a thermistor 62. The respective parts are described below.

[Coil]

As shown in FIG. 2, the induction heating coil 52 is arranged on a virtual arcuate surface extending along an arcuate outer surface of the heating belt 48 for induction heating in arcuate parts of the heat roller 46 and the heating belt 48. Actually, an unillustrated bobbin made of a resin is arranged at the outer side of the heat roller 46 (heating belt 48) and the induction heating coil 52 is arranged while being wound on this bobbin. The material of the bobbin is preferably made of a heat resistance resin (e.g. PPS, PET, LCP).

Although not shown in FIG. 2, the induction heating coil 52 is elliptically wound to have a major axis aligned in an axial direction of the heat roller 46 (heating belt 48 and fixing roller 45) in plan view (when viewed from above in FIG. 2). The length of the fixing roller 45 in the axial direction is such as to at least cover a maximum paper width of sheets (width of maximum size ones of sheets to be conveyed by the fixing unit 14). A winding area of the induction heating coil 52 spans in a range slightly longer than the entire length of the heat roller 46 in order to generate a magnetic field in the substantially entire axial (longitudinal) region of the heat roller 46 having a length corresponding to such a fixing roller 45. Accordingly, the induction heating coil 52 can induction heat substantially the entire longitudinal regions of the heat roller 46 and the heating belt 48. On the other hand, in the section shown in FIG. 2, a magnetic field can be generated substantially in an upper part of the heat roller 46. Thus, the induction heating coil 52 can induction heat substantially half the circumference of the heat roller 46 in a circumferential direction.

[Core]

The arch cores 54 are magnetic bodies arranged to face the heat roller 46 with the induction heating coil 52 located therebetween in order to form magnetic paths around the induction heating coil 52 and formed, for examples, by sintering ferrite powders. The arch cores 54 are arranged at a plurality of positions spaced apart in the axial direction of the heat roller 46 and paired at the left and right side as shown at each of these positions. The arrangement of the arch cores 54 is determined, for example, in accordance with a magnetic flux density (magnetic field intensity) of the induction heating coil 52.

Each individual arch core 54 at one arrangement position includes a quarter circular main body and the opposite ends of this main body are bent like hooks. The individual arch core 54 is so arranged as to embrace the winding part of the induction heating coil 52 at its inner circumferential side. In other words, the arch core 54 has an arcuate shape longer than the arrangement width of the induction heating coil 52 on the virtual arcuate surface.

These arch cores 54 are also arranged on the above bobbin (not shown). For example, an unillustrated core holder made of a resin is provided at the outer sides of the arch cores 54 to support the arch cores 54. The material of the core holder is also preferably made of a heat resistant resin (e.g. PPS, PET, LCP). Although each arch core 54 is integrally molded here, it may be divided into, for example, three pieces.

[Temperature Controller]

The temperature controller includes the thermistor 62 and a temperature control circuit 621. The thermistor 62 is disposed inside the heat roller 46 to detect the temperature of the heat roller 46. One or more thermistors 62 can be disposed at positions in the heat roller 46 where the amount of heat generation by induction heating is particularly large. For example, the thermistor 62 is desirably disposed at an inner side facing a longitudinal central position of the heat roller 46.

The temperature control circuit 621 provided in the image forming apparatus 1 controls a power supply device 521 of alternating current power supplied to the induction heating coil 52 based on the temperature detected by the thermistor 62. The temperature control circuit 621 controls the alternating current power supplied from the power supply device 521 to the induction heating coil 52 such that a temperature T detected by the thermistor 62 is maintained at a target temperature Ta necessary to fix a toner image to a sheet. This control may be performed by on-off controlling the power supply device 521. Alternatively, a control to be executed may be such that the amount of alternating current power supplied to the induction heating coil 52 is increased and decreased by changing the voltage and/or frequency of the alternating current power generated by the power supply device 521.

One or more unillustrated thermostats may be disposed inside the heat roller 46. The thermostats can be disposed at positions in the heat roller 46 where the amount of heat generation by induction heating is particularly large and operate in response to an excessive temperature increase of the heat roller 46 to stop the heating by the induction heating coil 52.

[Shielding Member]

A pair of magnetic shielding members 60 is arranged between the pair of arch cores 54 at each arrangement position. Although only a side view is shown in FIG. 2, each magnetic shielding member 60 are made of a nonmagnetic metal (e.g. oxygen-free copper) and has a rectangular closed frame portion in front view. The magnetic shielding members 60 are described in detail below.

Figure 3:
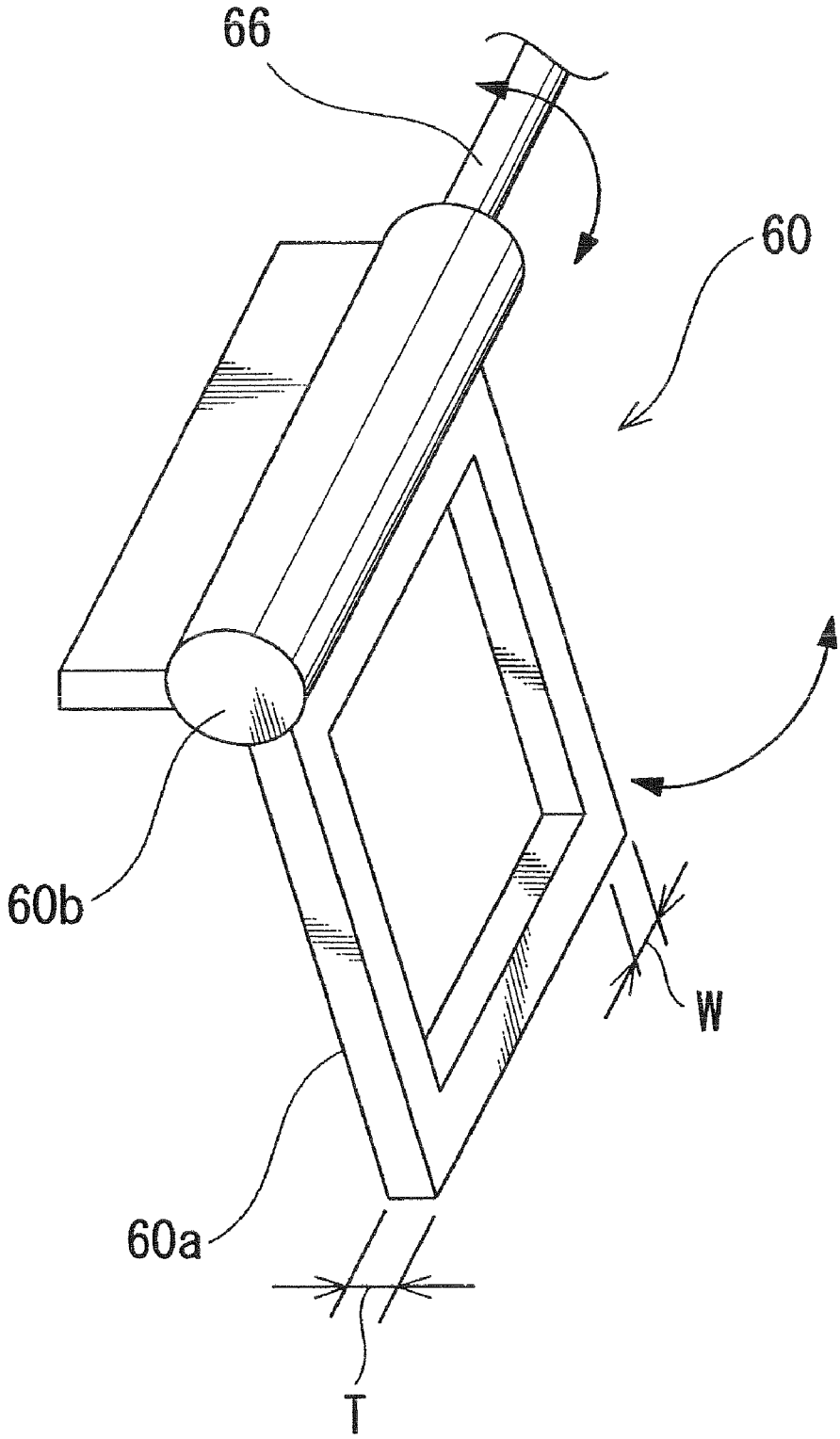
FIG. 3 is a view showing a structure example of a magnetic shielding member.

FIG. 3 is a perspective view showing a structure example of the magnetic shielding member 60. The magnetic shielding member 60 includes a frame portion 60*a* and a supporting member 60*b*. The frame portion 60*a* (closed frame portion) has a rectangular frame shape as a whole. The supporting member 60*b* includes a columnar main body and a laterally projecting plate-like part. One end (one of four sides) of the frame portion 60*a* is connected with the columnar main body. The supporting member 60*b* has one end thereof connected, for example, with a drive shaft 66. When this drive shaft 66 is rotated about its axial line, the magnetic shielding member 60 is displaced to swing about the supporting member 60*b*.

The supporting member 60*b* is arranged near one end of the arch core 54 when viewed in a circumferential direction of the heat roller 46. The frame portion 60*a* has an opening, into which one end (above hook-shaped bent portion) of the arch core 54 is insertable. In this embodiment, the supporting member 60*b* is arranged atop the one end of the arch core 54. The left magnetic shielding member 60 in FIG. 2 is rotated in a clockwise direction, so that the one end of the left arch core 54 enters the frame portion 60*a*. Further, the right magnetic shielding member 60 in FIG. 2 is rotated in a counterclockwise direction, so that the one end of the right arch core 54 enters the frame portion 60*a*.

The frame portion 60*a* of the shielding member 60 is preferably a member nonmagnetic and good in electrical conductivity in order to suppress Joule heat generation by induction heating and to efficiently shield magnetism. From this perspective, oxygen-free copper or the like is used as a material as described above. In order to improve the electrical conductivity of the magnetic shielding member 60, it is necessary to select a material with as small a specific resistance as possible and to increase the thickness of the material. In conditions found out by the inventors of the present invention, the thickness (T in FIG. 3) of the magnetic shielding members 60 is preferably equal to or larger than 0.5 mm and equal to or smaller than 3 mm. In this example, the magnetic shielding members 60 having a thickness of 1 mm are used. Further, the width (W in FIG. 3) of the magnetic shielding members 60 is preferably equal to or larger than 1 mm and equal to or smaller than 5 mm.

[Magnetic Shielding Portion]

The magnetic shielding member 60 is structured such that one end edge of the frame portion 60*a* is supported by the supporting member 60*b* as described above, and the drive shaft 66 is mounted at one end of the supporting member 60*b*. This drive shaft 66 is connected, for example, with an unillustrated driving mechanism (stepping motor and speed reducing mechanism). When the drive shaft 66 is rotated by the driving mechanism, the frame portion 60*a* can be displaced in a rotating direction together with the supporting member 60*b*.

Figure 4B:
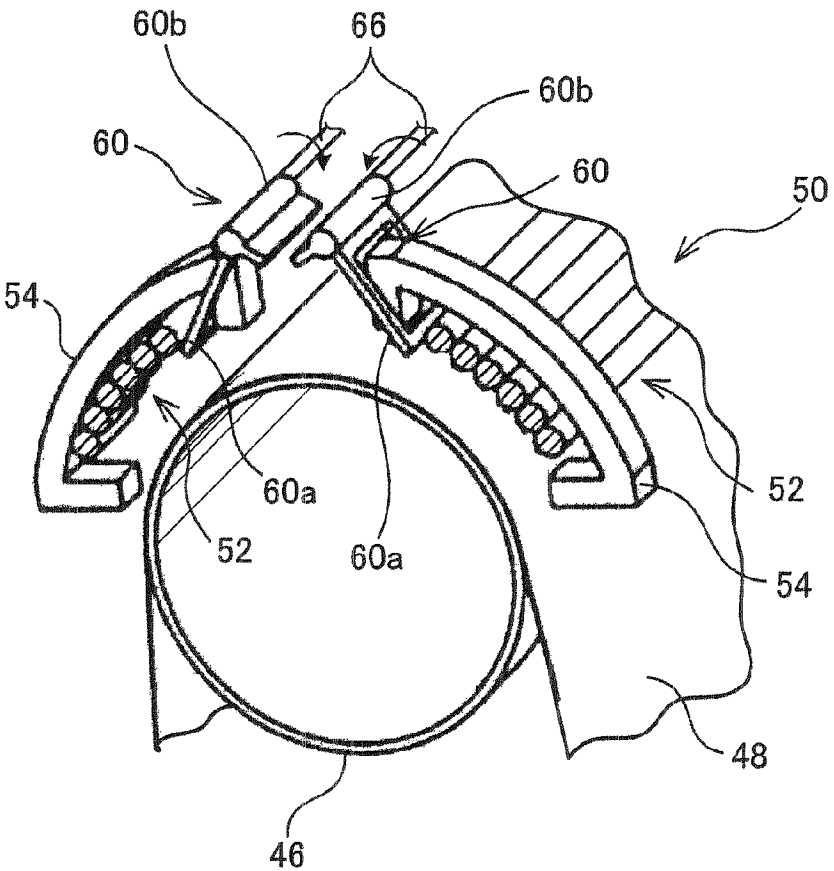
FIGS. 4A and 4B are perspective views showing operation examples for displacing the magnetic shielding member using a driving mechanism.
Figure 4A:
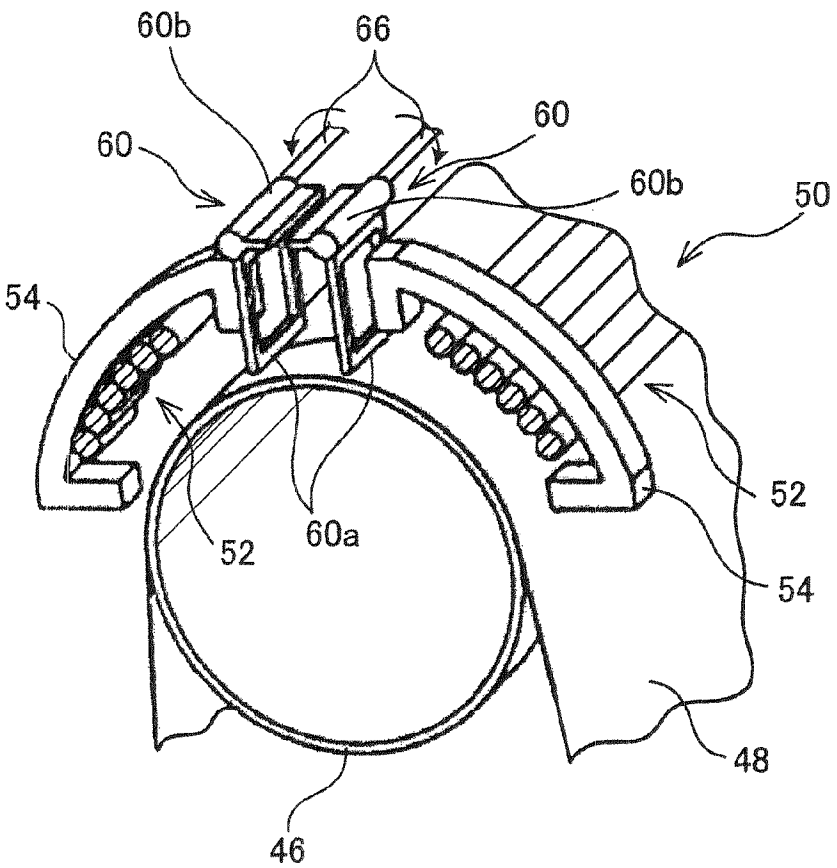

FIGS. 4A and 4B are perspective views showing operation examples of displacing the magnetic shielding members 60 using the above driving mechanisms. The respective operation examples are described below.

FIG. 4A shows a state where the magnetic shielding members 60 are displaced to retracted positions. The unillustrated driving mechanisms can control angles of rotation of the drive shafts 66 using these retracted positions as reference positions (initial states). For example, when unillustrated stepping motors are stopped at reference positions, two magnetic shielding members 60 are set in such postures hanging down substantially in parallel with the ends (end surfaces of the hook-shaped bent portions) of the corresponding arch cores 54. In this state, the frame portions 60*a* of the two magnetic shielding members 60 are arranged parallel to each other.

FIG. 4B shows a state where the magnetic shielding members 60 are displaced to shielding positions. The unillustrated driving mechanisms rotate the stepping motors by a specified number of steps from the above retracted positions (reference positions) to rotate the drive shafts 66 by a specified angle (e.g. about 30°) and stop them at those positions. In this state, the respective magnetic shielding members 60 are displaced such that the one ends of the respective arch cores 54 are located in the frame portions 60*a*. Further, in this state, the two magnetic shielding members 60 are arranged to form a substantially inverted V-shape together in a side view.

[Principle of the Magnetic Shielding Effect]

Figure 5A:
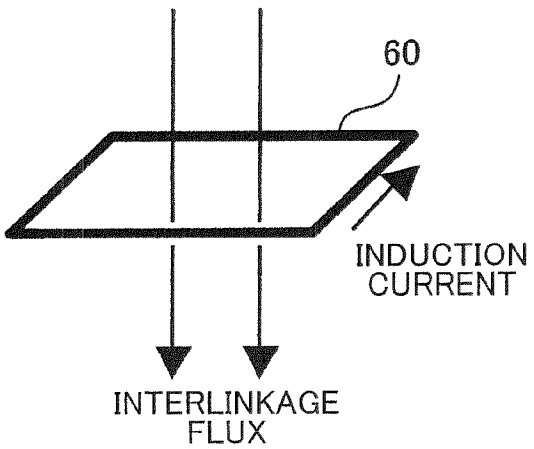
FIGS. 5A, 5B and 5C are diagrams showing the principle of a magnetic shielding effect by the magnetic shielding member.
Figure 5B:
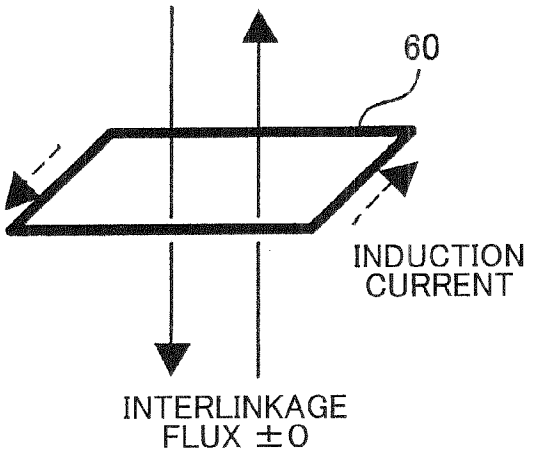
Figure 5B:
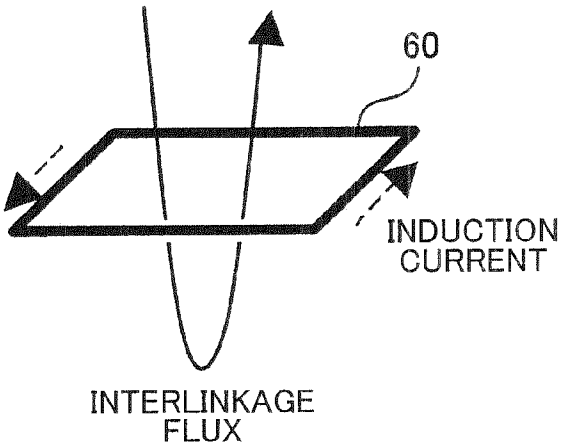
Figure 5C:
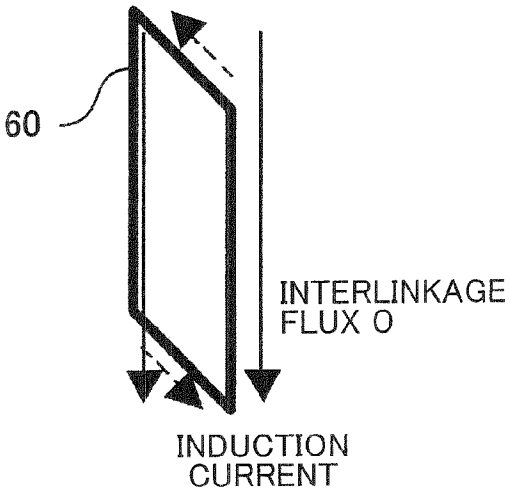

FIGS. 5A to 5C are diagrams showing the principle of the magnetic shielding member 60. In FIGS. 5A to 5C, the magnetic shielding member 60 is simply shown as a mere wire model.

If a penetrating magnetic field (interlinkage flux) is generated in a direction (one direction) perpendicular to a frame surface (virtual plane formed in the frame portion 60*a*) of the frame-shaped magnetic shielding member 60, an induction current is accordingly produced in a circumferential direction of the magnetic shielding member 60 as shown in FIG. 5A. Then, a magnetic field (opposite magnetic field) acting in a direction opposite to the penetrating magnetic field is generated by electromagnetic induction, wherefore these magnetic fields cancel each other to eliminate the magnetic fields. In this embodiment, magnetism is shielded using this magnetic field canceling effect (state of FIG. 4B).

A case is assumed where penetrating magnetic fields are generated in both directions through the frame surface of the frame-shaped magnetic shielding member 60 as shown in an upper part of FIG. 5B and the sum total of the interlinkage fluxes at this time are substantially 0 (±0). In this case, substantially no induction current is generated in the magnetic shielding member 60. Accordingly, the magnetic shielding member 60 hardly exhibits its magnetic field canceling effect and the magnetic fields just pass the magnetic shielding member 60 in both directions. This similarly holds also in the case where a magnetic field passes the inner side of the magnetic shielding member 60 in a U-turn direction as shown in a lower part of FIG. 5B.

FIG. 5C shows a case where a magnetic field (interlinkage flux) is generated substantially in parallel with the frame surface of the frame-shaped magnetic shielding member 60. In this case as well, substantially no induction current is generated in the magnetic shielding member 60, wherefore there is no magnetic field canceling effect. In this embodiment, induction heating efficiency is increased by retracting the magnetic shielding members 60 to such positions where the magnetic field canceling effect cannot be obtained (state of FIG. 4A).

In this embodiment is employed such a technique for exhibiting a magnetic shielding effect and increasing the induction heating efficiency without shielding magnetism by switching a magnetic field environment between the one shown in FIG. 5C and the one shown in FIG. 5A through the displacement of the magnetic shielding members 60 near the induction heating coil 52. A specific example of the magnetic shielding technique is described below.

Figure 6B:
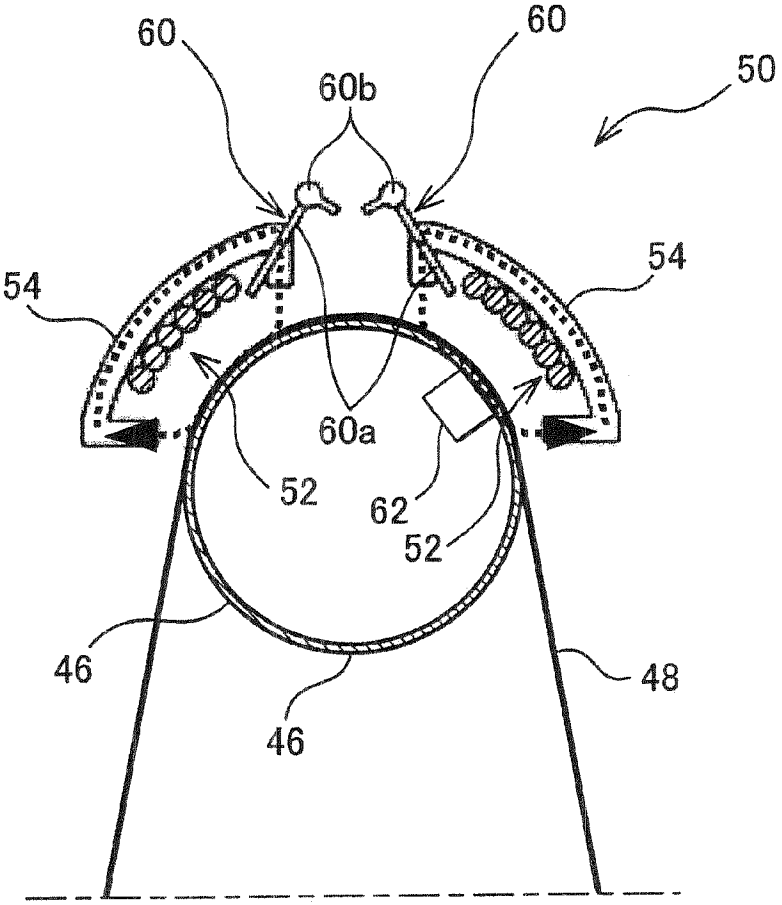
FIGS. 6A and 6B are diagrams showing specific examples of a magnetic shielding technique using the magnetic shielding members.
Figure 6A:
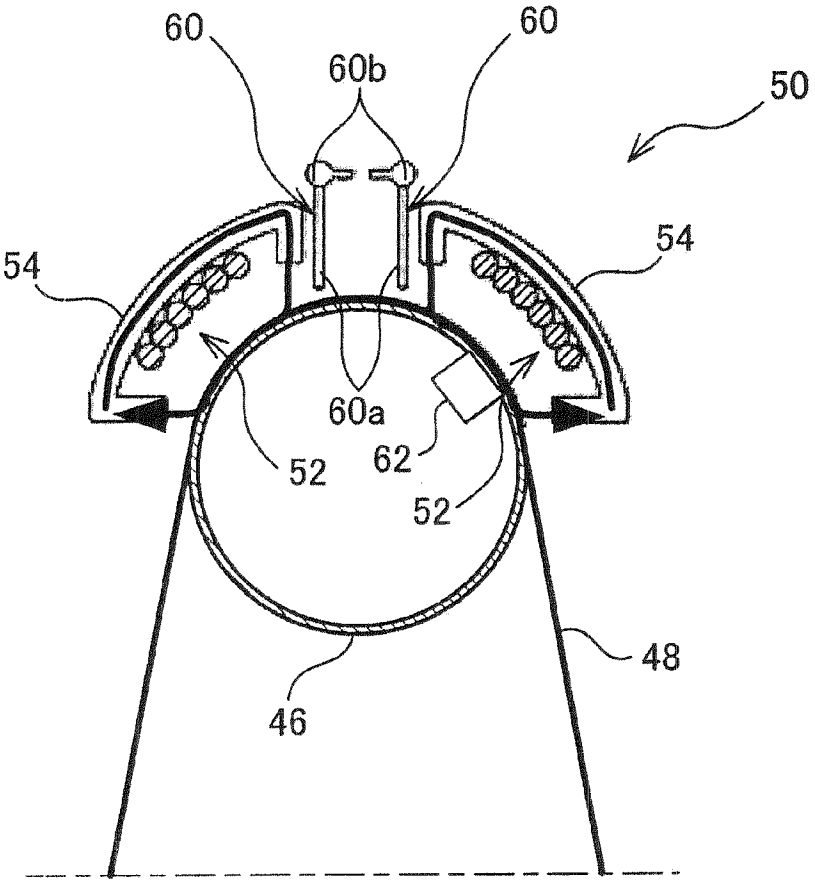

FIGS. 6A and 6B are diagrams showing the specific example of the magnetic shielding technique using the magnetic shielding members 60, wherein FIG. 6A shows a state where the magnetic shielding members 60 are displaced to the retracted positions and FIG. 6B shows a state where the magnetic shielding members 60 are displaced to the shielding positions.

[Retracted Position]

When power is applied to the induction heating coil 52 as shown by arrows in FIG. 6A, magnetic paths extending to the heat roller 46 and the heating belt 48 via the arch cores 54 are formed around the induction heating coil 52. With the magnetic shielding members 60 displaced to the retracted positions, the respective magnetic shielding members 60 are separated from the one ends of the respective arch cores 54 and kept in parallel postures to the one ends. As a result, magnetic fluxes are permitted to pass positions parallel to and distant from the frame surfaces of the magnetic shielding members 60.

In this case, no magnetic field canceling effect acts on the magnetic shielding members by the principle shown in FIG. 5C. Accordingly, there is no likelihood of hindering the magnetic field intensity of the induction heating coil 52 with the magnetic shielding members 60 displaced to the retracted positions. In this way, it is possible to highly efficiently induction heat the heat roller 46 and the heating belt 48 and to shorten a warm-up time.

[Shielding Position]

If the magnetic shielding members 60 are displaced to the shielding positions as shown in FIG. 6B, the one ends of the arch cores 54 are relatively inserted into the insides of the frame portions 60*a*. As a result, magnetic fluxes penetrate through the frame surfaces of the magnetic shielding members 60. Accordingly, the magnetic field is canceled by the principle shown in FIG. 5A, wherefore magnetism can be shielded at the arrangement positions of the magnetic shielding members 60.

[Dealing with Size Switching]

Sheet sizes (paper widths) can be dealt with, for example, as follows. Specifically, the magnetic shielding members 60 are respectively provided for all the arch cores 54 located at the opposite outer sides of a minimum paper area (width of minimum ones of sheets to be conveyed by the fixing unit 14) in the axial direction of the heat roller 46. These plurality of magnetic shielding members 60 are displaced one by one or by plural numbers by the unillustrated driving mechanisms.

In the above structure, by displacing the magnetic shielding members 60 located at the outer sides of the paper area (in paper non-passage areas) to the shielding positions in accordance with the size of a sheet to have an image formed thereon, an excessive temperature increase of the heating belt 48 in the paper non-passage areas can be prevented. Although it also depends on the number of the arranged arch cores 54, a plurality of sheet sizes can be dealt with by respectively arranging the magnetic shielding members 60 in ranges corresponding to the respective paper widths, for example, corresponding to A5 vertical, A4 vertical, B4 vertical and A4 horizontal.

[Other Structure Examples]

Figure 7:
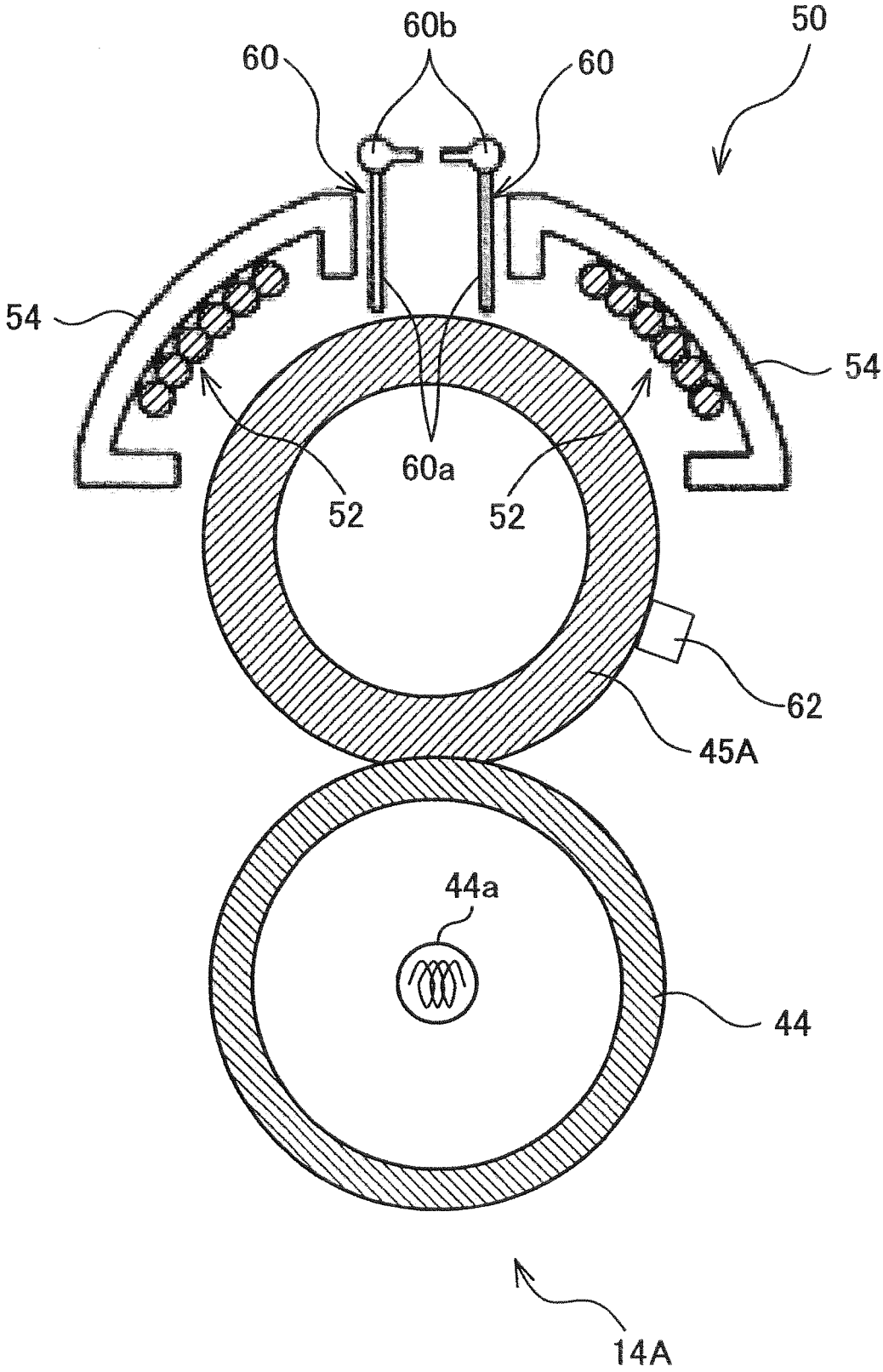
FIG. 7 is a diagram showing another structure example of the fixing unit.

FIG. 7 is a diagram showing a fixing unit 14A according to a first modification of the fixing unit 14. In this structure example, a toner image is fixed by a fixing roller 45A and the pressure roller 44 without using the above heating belt 48. The IH coil unit 50 is arranged to face the circumferential surface of this fixing roller 45A.

A magnetic body similar to the above heating belt is, for example, wound around the outer circumferential surface of the fixing roller 45A, and the magnetic body is induction heated by the induction heating coil 52. In this case, the thermistor 62 is disposed at a position outside the fixing roller 45 to face a layer of the magnetic body. The rest is similar to the above and the magnetic shielding members 60 are displaced between the retracted positions and the shielding positions as a sheet size is changed.

Figure 8:
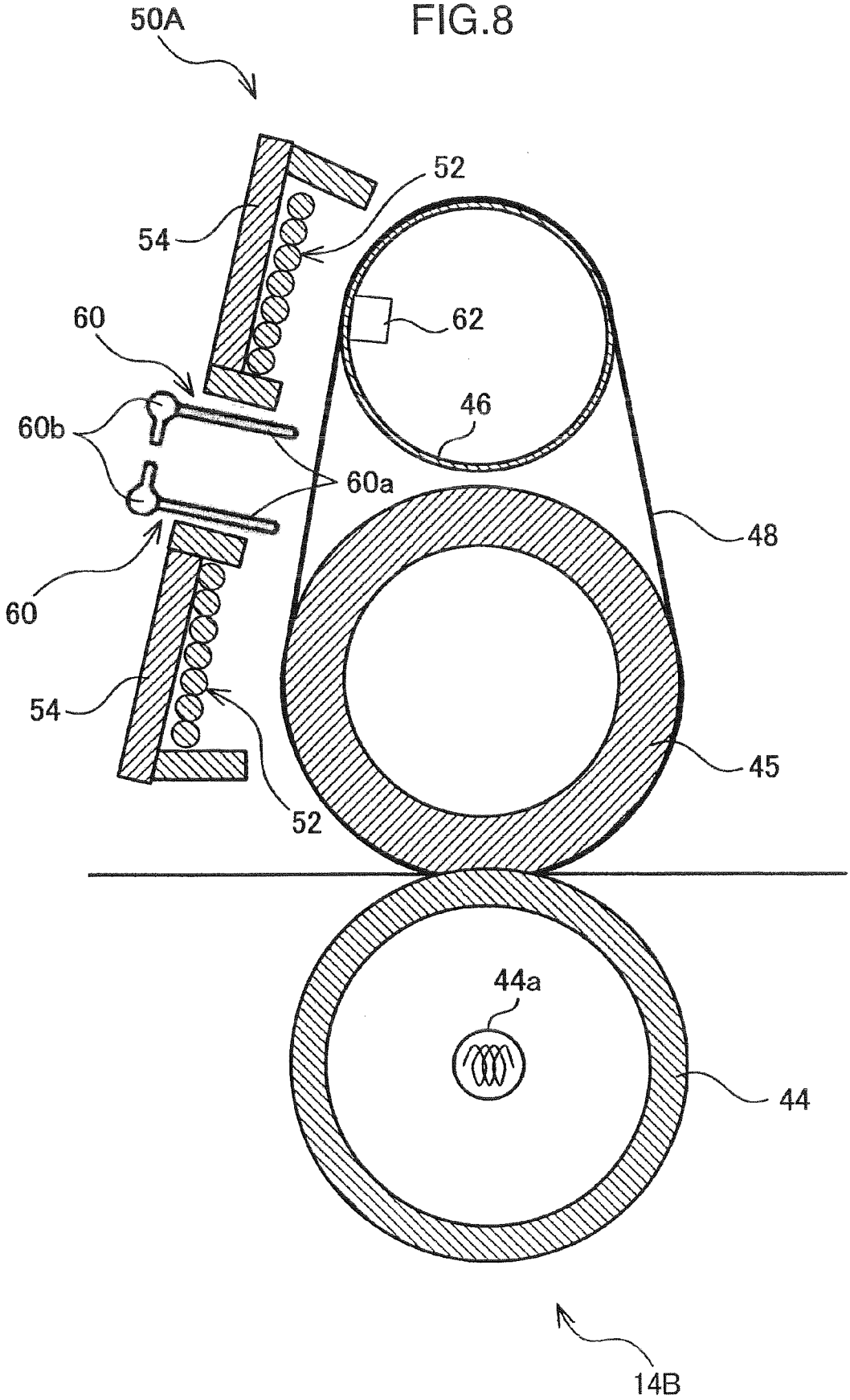
FIG. 8 is a diagram showing another structure example of an IH coil unit.

FIG. 8 is a diagram showing a fixing unit 14B according to a second embodiment of the fixing unit 14. In this example, an IH coil unit 50A having a different mode is used. In this structure example, the IH coil unit 50A induction heats not at an arcuate position of the heating belt 48, but at a flat position of the heating belt 48 between the heat roller 46 and the fixing roller 45. In this case as well, a change in the sheet size can be dealt with by displacing the respective magnetic shielding members 60. Although each arch core 54 is made up of three pieces in this example, it may be integrally molded as a whole.

Various embodiments of the present invention are described, but the present invention can be embodied while being variously modified without being limited to the above embodiments. For example, the shape and arrangement of the magnetic shielding members 60 are not limited to the shown ones and other shape and arrangement may be employed.

Although the magnetic shielding members 60 are displaced as the drive shafts 66 are rotated in one embodiment, they may be displaced, for example, by slide mechanisms each using a rack and a pinion or link mechanisms each using a link lever and a link rod.

Alternatively, the displacing directions of the magnetic shielding members 60 are not limited to the rotating directions as in one embodiment and two magnetic shielding members 60 may be horizontally slid so as to move toward and away from each other.

The above specific embodiments mainly embrace inventions having the following constructions.

An image forming apparatus according to one aspect of the present invention comprises an image forming unit for transferring a toner image to a sheet and a fixing unit including a heating member and a pressing member and adapted to convey the sheet while holding the sheet between the heating member and the pressing member and to fix the toner image to the sheet by heat at least from the heating member in a conveying process, wherein the fixing unit includes a coil arranged along an outer surface of the heating member for generating a magnetic field for induction heating the heating member; a core arranged to face the heating member with the coil located therebetween in order to form a magnetic path around the coil and made of a magnetic material; a shielding member arranged near the magnetic path generated by the coil, including a closed frame portion and made of a nonmagnetic metal; and a magnetic shielding portion for displacing the shielding member between a retracted position for permitting a magnetic flux to pass along a frame surface virtually formed inside the closed frame portion and a shielding position for shielding magnetism by the penetration of a magnetic flux inside the frame surface.

According to this construction, the shielding member has a unique closed frame shape made of the nonmagnetic metal. Specifically, if the nonmagnetic metal in the closed frame shape is placed in a magnetic field, a perpendicular magnetic field (interlinkage flux) penetrates through the frame surface (virtual frame surface) inside the closed frame portion, whereby an induction current is produced in a circumferential direction of the closed frame portion. An opposite magnetic field acting in a direction opposite to the penetrating magnetic field is generated by this induction current. This opposite magnetic field cancels the magnetic field (interlinkage flux) penetrating inside the closed frame portion in a perpendicular direction, whereby a magnetic shielding effect can be exhibited.

Such a shielding member exhibits a high shielding effect when a magnetic field is generated in one direction to perpendicularly penetrate the inside of the closed frame portion, but no shielding effect is exhibited if the frame surface is located substantially in parallel with a passage direction of the magnetic flux in the magnetic field. Accordingly, the shielding member is displaced to a position (shielding position) where the magnetic flux penetrates the frame surface in one direction at an intermediate position of a magnetic path when shielding is performed, whereby a sufficient magnetic shielding effect can be obtained. On the other hand, no magnetic shielding effect can be exhibited by displacing the shielding member to a position (retracted position) where the frame surface is parallel to the passage direction of the magnetic flux when no shielding is performed.

In this way, it is possible to obtain a sufficient temperature increase and to shorten a warm-up time without reducing heat generation efficiency upon induction heating the heating member. Further, even if the shielding member is arranged near the magnetic path, the magnetic flux passes along the shielding member at the retracted position, wherefore it is not necessary to largely distance the shielding member from the magnetic path. Thus, it is not necessary to retract the shielding member to outer sides of the coil and core and to ensure a storage space, and space saving can be promoted by that much. Since the shielding member includes the closed frame portion and has a hollow shaped, the mass of the member can be suppressed to a small level even if a sufficiently large range (frame width) is ensured. Therefore, a reduction in material cost can be promoted and power (e.g. motor output) for displacing the shielding member can be suppressed to a minimum level.

In the above construction, it is preferable that the closed frame portion has such a size as to permit the core to be relatively inserted thereinto; and that the core is inserted into the inside of the closed frame portion to shield magnetism when the shielding member is displaced to the shielding position by the magnetic shielding portion.

If such a construction is employed, the magnetic shielding effect can be efficiently exhibited since a magnetic flux can more reliably penetrate through the frame surface. Further, even with the shielding member displaced to the shielding position, the shielding member is only so arranged as to surround the outer side (outer circumference) of the core, wherefore there is no likelihood of inadvertently enlarging a space necessary for the entire fixing unit.

In the above construction, the shielding member includes a columnar supporting member and the closed frame portion fixed to the circumferential surface of the supporting member; and that the magnetic shielding portion includes a drive shaft connected with one end of the supporting member and displaces the shielding member between the retracted position and the shielding position by rotating the drive shaft to rotate the supporting member about its axis. According to this construction, the shielding member can be easily displaced only by rotating the drive shaft.

In this case, it is preferable that the heating member includes an arcuate part; that the core is an arch core having an arcuate shape; that the supporting member is arranged near one end of the arch core; and that the closed frame portion has such a size as to permit the one end of the arch core to be relatively inserted thereinto and shields magnetism by permitting the one end of the arch core to be inserted thereinto when the shielding member is displaced to the shielding position by the magnetic shielding portion while substantially shielding no magnetism by permitting the one end of the arch core to come out therefrom when the shielding member is displaced to the retracted position. According to this construction, the space necessary for the entire fixing unit can be more suppressed.

In the above construction, a current flowing in the circumferential direction of the closed frame portion upon the generation of a magnetic field by the coil is substantially 0 with the shielding member displaced to the retracted position by the magnetic shielding portion. In other words, if the current flowing in the closed frame portion is 0 at the retracted position, no opposite magnetic field is generated in response to the magnetic field generated by the coil, wherefore the magnetic induction of the heating member is not hindered.

The shielding member is preferably made of a conductor whose width is in a range of 1 mm to 5 mm and whose thickness is in a range of 0.5 mm to 3 mm. Specifically, the shielding member needs to have as small a specific resistance (electrical resistance) as possible in order to suppress its own generation of Joule heat to efficiently shield magnetism. If the shielding member is dimensioned as above, it is possible to ensure good electrical conductivity, to obtain a sufficient magnetic shielding effect and to make the shielding member lighter by sufficiently decreasing the specific resistance of the shielding member.

The shielding member is preferably made of a nonmagnetic metal including copper. By doing so, a good magnetic shielding effect can be obtained by decreasing the specific resistance of the shielding member and suppressing the generation of Joule heat of the shielding member.

The heating member may be a metallic roller or may be a metallic belt. Either case is preferable for an induction heating method by a coil.

In the above construction, it is preferable that the heating member has an arcuate part; that the coil is arranged on a virtual arcuate surface extending along the arcuate outer surface of the heating member; that the core is an arch core having the arcuate shape longer than an arrangement width of the coil on the arcuate surface; that the shielding member includes a columnar supporting member and the closed frame portion fixed to the circumferential surface of the supporting member; that the closed frame portion has such a size as to permit the one end of the arch core to be relatively inserted thereinto; that the magnetic shielding portion includes a drive shaft connected with one end of the supporting member and displaces the shielding member between the retracted position and the shielding position by rotating the drive shaft to rotate the supporting member about its axis; and that the one end of the arch core is inserted into the inside of the closed frame portion when the shielding member is displaced to the shielding position by the rotation of the supporting member about its axis, whereas the one end of the arch core comes out from the inside of the closed frame portion when the shielding member is displaced to the retracted position. According to this construction, the space necessary for the entire fixing unit can be more suppressed.

According to the present invention described above, it is possible to exhibit sufficient heat generation efficiency when the shielding member is displaced to the retracted position, to shield magnetism by the shielding member upon switching a sheet size and to reliably prevent an excessive temperature increase of the heating member while space saving is promoted for the entire fixing unit.

This application is based on Japanese Patent Application No. 2008-057316 filed on Mar. 7, 2008, respectively, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus, comprising:

an image forming unit for transferring a toner image to a sheet; and a fixing unit including a heating member and a pressing member and adapted to convey the sheet while holding the sheet between the heating member and the pressing member and to fix the toner image to the sheet by heat at least from the heating member in a conveying process, wherein the fixing unit further includes:

a coil arranged along an outer surface of the heating member for generating a magnetic field for induction heating the heating member;

a core arranged to face the heating member with the coil located therebetween in order to form a magnetic path around the coil and made of a magnetic material;

a shielding member arranged on a side of the outer surface of the heating member and near the magnetic path generated by the coil, including a closed frame portion and made of a nonmagnetic metal; and a magnetic shielding portion for displacing the shielding member between a retracted position for permitting a magnetic flux to pass along a frame surface virtually formed inside the closed frame portion and a shielding position for shielding magnetism by the penetration of a magnetic flux inside the frame surface.

2. An image forming apparatus according to claim 1, wherein:

the closed frame portion has such a size as to permit the core to be relatively inserted thereinto; and the core is inserted into the inside of the closed frame portion to shield magnetism when the shielding member is displaced to the shielding position by the magnetic shielding portion.

3. An image forming apparatus according to claim 1, wherein:

the shielding member includes a columnar supporting member and the closed frame portion fixed to the circumferential surface of the supporting member; and the magnetic shielding portion includes a drive shaft connected with one end of the supporting member and displaces the shielding member between the retracted position and the shielding position by rotating the drive shaft to rotate the supporting member about its axis.

4. An image forming apparatus according to claim 3, wherein:

the heating member includes an arcuate part;

the core is an arch core having an arcuate shape;

the supporting member is arranged near one end of the arch core; and the closed frame portion has such a size as to permit the one end of the arch core to be relatively inserted thereinto and shields magnetism by permitting the one end of the arch core to be inserted thereinto when the shielding member is displaced to the shielding position by the magnetic shielding portion while substantially shielding no magnetism by permitting the one end of the arch core to come out therefrom when the shielding member is displaced to the retracted position.

5. An image forming apparatus according to claim 1, wherein a current flowing in the circumferential direction of the closed frame portion upon the generation of a magnetic field by the coil is substantially 0 with the shielding member displaced to the retracted position by the magnetic shielding portion.

6. An image forming apparatus according to claim 1, wherein the shielding member is made of a conductor whose width is in a range of 1 mm to 5 mm and whose thickness is in a range of 0.5 mm to 3 mm.

7. An image forming apparatus according to claim 1, wherein the shielding member is made of a nonmagnetic metal including copper.

8. An image forming apparatus according to claim 1, wherein the heating member is a metallic roller.

9. An image forming apparatus according to claim 1, wherein the heating member is a metallic belt.

10. An image forming apparatus according to claim 1, wherein:

the heating member has an arcuate part;

the coil is arranged on a virtual arcuate surface extending along the arcuate outer surface of the heating member;

the core is an arch core having the arcuate shape longer than an arrangement width of the coil on the arcuate surface;

the shielding member includes a columnar supporting member and the closed frame portion fixed to the circumferential surface of the supporting member;

the closed frame portion has such a size as to permit the one end of the arch core to be relatively inserted thereinto;

the magnetic shielding portion includes a drive shaft connected with one end of the supporting member and displaces the shielding member between the retracted position and the shielding position by rotating the drive shaft to rotate the supporting member about its axis, the one end of the arch core is inserted into the inside of the closed frame portion when the shielding member is displaced to the shielding position by the rotation of the supporting member about its axis, whereas the one end of the arch core comes out from the inside of the closed frame portion when the shielding member is displaced to the retracted position.

11. An image forming apparatus, comprising:

an image forming unit for transferring a toner image to a sheet; and a fixing unit including a heating member and a pressing member and adapted to convey the sheet while holding the sheet between the heating member and the pressing member and to fix the toner image to the sheet by heat at least from the heating member in a conveying process, wherein the fixing unit further includes:

a coil arranged along an outer surface of the heating member for generating a magnetic field for induction heating the heating member;

a core arranged to face the heating member with the coil located therebetween in order to form a magnetic path around the coil and made of a magnetic material;

a shielding member arranged near the magnetic path generated by the coil, including a closed frame portion and made of a nonmagnetic metal, the closed frame portion having a size to permit the core to be relatively inserted therein; and a magnetic shielding portion for displacing the shielding member between a retracted position for permitting a magnetic flux to pass along a frame surface virtually formed inside the closed frame portion and a shielding position where the core is inserted into the closed frame portion for shielding magnetism by the penetration of a magnetic flux inside the frame surface.

12. An image forming apparatus according to claim 11, wherein a current flowing in the circumferential direction of the closed frame portion upon the generation of a magnetic field by the coil is substantially 0 with the shielding member displaced to the retracted position by the magnetic shielding portion.

13. An image forming apparatus according to claim 11, wherein the shielding member is made of a conductor whose width is in a range of 1 mm to 5 mm and whose thickness is in a range of 0.5 mm to 3 mm.

14. An image forming apparatus according to claim 11, wherein the shielding member is made of a nonmagnetic metal including copper.

15. An image forming apparatus according to claim 11, wherein the heating member is a metallic roller.

16. An image forming apparatus according to claim 11, wherein the heating member is a metallic belt.

17. An image forming apparatus, comprising:

an image forming unit for transferring a toner image to a sheet; and a fixing unit including a heating member and a pressing member and adapted to convey the sheet while holding the sheet between the heating member and the pressing member and to fix the toner image to the sheet by heat at least from the heating member in a conveying process, the heating member including an arcuate part, wherein the fixing unit further includes:

a coil arranged along an outer surface of the heating member for generating a magnetic field for induction heating the heating member;

an arch core having an arcuate shape and arranged to face the arcuate part of the heating member with the coil located therebetween in order to form a magnetic path around the coil and made of a magnetic material;

a shielding member arranged near the magnetic path generated by the coil, the shielding member including a support arranged near one end of the arch core and a closed frame portion fixed to an outer surface of the support and made of a nonmagnetic metal, the closed frame portion having a size to permit the one end of the arch core to be relatively inserted therein; and a magnetic shielding portion including a drive shaft connected with the support for displacing the shielding member between a retracted position for permitting a magnetic flux to pass along a frame surface virtually formed inside the closed frame portion and a shielding position for shielding magnetism by the penetration of a magnetic flux inside the frame surface.

18. An image forming apparatus according to claim 17, wherein the shielding member is made of a nonmagnetic metal including copper.

19. An image forming apparatus according to claim 17, wherein the heating member is a metallic roller.

20. An image forming apparatus according to claim 17, wherein the heating member is a metallic belt.

* * * * *